US005847636A

United States Patent [19]

Sehlhorst

[11] Patent Number: 5,847,636

[45] Date of Patent: Dec. 8, 1998

[54] HEAT MOTOR OPERATED LOAD REGULATING SWITCH ASSEMBLY

[76] Inventor: Scott B. Sehlhorst, 5615 Old Dover Rd. #7, Fort Wayne, Ind. 46835

[21] Appl. No.: 797,531

[22] Filed: Feb. 7, 1997

[51] Int. Cl.[6] ..... H01H 37/12

[52] U.S. Cl. ..... 337/303; 337/333; 337/342; 337/380

[58] Field of Search ..... 337/37, 38, 39, 337/41, 51, 52, 53, 83, 93, 94, 82, 57, 106, 103, 105, 107, 101, 104, 113, 333, 337, 324, 348, 377, 380, 342, 394; 219/511

[56] References Cited

U.S. PATENT DOCUMENTS

| | | | |
|---|---|---|---|
| 5,021,762 | 6/1991 | Hetrick | 337/103 |
| 5,191,310 | 3/1993 | Obermann et al. | 337/105 |
| 5,696,479 | 12/1997 | Oughton et al. | 337/333 |

*Primary Examiner*—Michael W. Phillips
*Assistant Examiner*—Anatoly Vortman
*Attorney, Agent, or Firm*—Leydig, Voit & Mayer, Lt

[57] ABSTRACT

A user adjustable switching controller for duty cycle regulating flow of current to an electrical load such as a resistance heater, particularly for cooking appliances. A load current switch, when closed by a user operated cam also energizes a heat motor which includes a resistive strip attached to one active leg of a U-shaped bi-metal member. The load current switch snap spring is attached to the heated leg of the bi-metal. The other leg of the U-shaped bi-metal is anchored to one of the load connecting stationary terminals and serves to provide ambient temperature compensation. User rotation of the cam deflects a bias spring which acts on the portion of the bi-metal attached to the load switch snap spring to effect closing of the load current switch and energization of the heat motor. Heating of the bi-metal causes warpage which overcomes the bias spring to open the load switch and shut off the heat motor. Cooling of the bi-metal allows the load current switch to re-close repeating the cycle. User adjustment of the cam varies the bias on the snap spring and thus the re-open point of the switch with respect to the cycle, thereby varying the ratio of "on" to "off" time of the load current.

21 Claims, 12 Drawing Sheets

34
40
36
30
38
N
P
S2
54
62
L2
−120vAC
S1
L2b
116
H2b
46
R1
70
H2
92
L1b
+120v.AC
H1
50
L1
114

34
36
30'
38
OPTIONAL
CONNECTION
P
S2
118
L2
58
S1
−120vAC
L2b
120
116
H2b
R1
70
H2
92
L1b
+120v.AC
H1
50
L1
114

HEAT MOTOR OPERATED LOAD REGULATING SWITCH ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

The present invention relates to controllers or switch assemblies used for fractional duty cycle modulation of an electrical load, for example an electrical resistance heater employed in an oven or range top "burner" heater. Controllers of this type are employed in domestic cooking appliances; and, typically the duty cycle of the heater is variable by user rotation of a control knob associated with the switch assembly controlling the load current to the heater.

Heretofore, controllers for domestic cooking ovens of the aforesaid type, have utilized a cam which moves with the user rotatable knob for varying the bias on the load current switch which is actuated by a heat motor energized only when load current is flowing through the heater switch. The user rotation of the control knob positions the cam to provide a predetermined bias on the load current switch actuating mechanism which in turn varies the amount of time that the load heater is on. The heat motor includes a resistance which is typically connected for heating a bi-metal actuator which warps in response to heat transfer from the resistance to cause de-actuation of the switch which cuts off of the load current to the oven heater and to the heat motor. In such an arrangement, the time required for the bi-metal actuator to cool upon opening of the load current switch determines the ratio of the "on" time to "off" time.

Known constructions for variable duty cycle load or heater controllers have employed a bi-metal actuator for the load current switch which has a heat motor attached thereto comprising a relatively thin film resistive heater superposed on a rigid substrate and mounted on the bi-metal member. This arrangement of the heat motor has been found generally operative; however, as the bi-metal member is heated by heat transfer from the heat motor, the warpage or deflection induced in the bi-metal member causes the bi-metal to pull away from the rigid heat motor substrate, thereby diminishing the heat transfer from the heat motor to the bi-metal and introducing inaccuracies non-proportionality and hysteresis in the movement of the bi-metal with respect to the energy input to the heater. This warpage of the bi-metal away from the heater has resulted in difficulties in calibrating the heat motor with respect to the actuating point of the load current switch for the energy input to the heat motor. Additionally, the known arrangements for such controllers have applied to the bias from the user rotated cam to one portion of the snap acting load current switch and have applied the bias from the heat motor bi-metal to another portion of the switch. This arrangement has resulted in difficulty in calibrating the controller to provide the desired duty cycle or ratio of "on" time to "off" time of the load heater being controlled and has diminished the repeatability of the switch when calibrated.

Furthermore, known arrangements for the user actuated cam to vary the bias on the load current switch have resulted in numerous parts, complexity and difficulty in calibrating the controller as to the position of the cam with respect to the desired fractional duty cycle of the load heater.

Referring to FIGS. 7 and 10, a known heater controller for domestic cooking ovens is shown wherein the user cam 1 causes a cam follower 2 having one end attached to a blade member 3 cantilevered from stationary structure which causes the cam follower to bias the blade spring 3 in an upward direction. A snap acting blade spring 4 is attached to the blade member 3; and, the spring 4 has a moveable contact 5 on one end thereof which is effective upon movement of the spring 4 for opening and closing against the stationary contact 6. The end of the blade spring 4 is biased downwardly at the end distal contact 5 by the end of a bi-metal member 7, which has attached thereto a heat motor indicated generally at 8, which comprises a relatively thin film resistor mounted on a ceramic substrate 9 with one end of the resistor connected electrically to a cantilevered contact strip 10 with the other distal end thereof contacted by a wiper 11 which is connected to one side of a power line through a cam actuated switch 12. The member 10 and the blade spring 3 are connected to a common member 13 which is connected to the opposite side of the power line from switch 12. A calibration screw 14 which is accessible through a hole in the housing 15 is provided for adjustment of the upright position of the bi-metal actuator 7.

FIG. 7 shows the electrical schematic for the device of FIG. 10 in which the heat motor 8 has one side connected through junction 16 to one side of the switch 12; and, the other side of the heat motor is connected to junction 17 which is connected through a cam actuated switch 18 to a junction 19 which is connected to the opposite side of the power line.

Junctions 16 and 18 are connected through load terminals H1, H2 to the heater load indicated at 22. Switch 12 includes the stationary contact 6 and the movable contact 5 as shown in FIG. 10. The prior art device of FIG. 7 includes a pilot lamp 24 connected through a terminal denoted P and through cam operated switch 20 to junction 19.

Referring to FIG. 8, another known heat motor actuated controller is shown schematically wherein a first and second electrical load heaters 25, 26 are connected in parallel with the second load heater 26 being series connected to the switch 18'.

FIG. 9 shows another known heat motor actuated directional duty cycle heater controller having a single load heater 27 series connected with the heat motor 8" to the cam actuated switch 12". Heat motor 8" acts on cam actuated switch 12" in the same manner as in the device of FIG. 7.

The known devices are complex in that many parts are required; in particular, the assembly of the members 8, 9, 7, 10, 13 and 3 in the FIG. 10 prior art device are noted as requiring riveting or weldment and are consequently difficult to assemble in the housing. In addition, the three piece structure of members 2, 3 and 4 is difficult to form as a subassembly and install in the housing.

Therefore, it has long been desired to find a way or means of providing a heat motor actuated duty cycle modulating controller for an electrical load such as an electrical resistance heater and to provide such a device which is simple to assemble, has a minimum of parts and is low in manufacturing costs and easy to calibrate is accurately repeatable when calibrated and reliable in operation over extended service life.

BRIEF SUMMARY OF THE INVENTION

It is an object of the present invention to provide a heat motor actuated controller for duty cycling the load current of an electrical load with a user selectable input for the fraction of the duty cycle in which the load current is "on".

It is a further object of the present invention to provide a controller for regulating the load current to an electrical load such as an electrical resistance heater and to provide user selection of the ratio of "on" time to "off" time in a easy to assembly device which has a minimum of parts and is low in manufacturing costs, accurately repeatable and reliable in service.

It is a further object of the present invention to provide a controller for duty cycle regulating an electrical load such as an oven heater with user input for selecting the percentage of duty cycle and which employs a heat motor for cycling the load current switch in the controller.

It is a further object of the present invention to provide a controller for duty cycle regulating an electrical resistance load with user selection of the percentage of duty cycle and which has the user input comprising a rotatable knob which operates a selector cam.

It is a further object of the present invention to provide an electrical controller having a user input knob which is axially assembled over the rotatable shaft and frictionally retained thereon by a spring formed as one piece with the shaft.

It is a farther object of the present invention to provide a user variable duty cycle controller for regulating current to an electrical resistance load and employing a bi-metal member heated by a resistance heater with the user input rotating a cam which acts directly on the bi-metal actuator.

It is a further object of the present invention to provide a controller for duty cycle regulating an electrical resistance load where the heat motor is connected to a movable contact member having an integral snap spring formed therewith with the heat motor providing a force input to the snap spring at a location intermediate the ends of the moveable contact member.

The present invention utilizes a heat motor in the form of a relatively thin film resistor superposed on a rigid substrate and mounted on one leg of a generally U-shaped bi-metal member having end portions of the opposite leg of the U-shape operative upon heating of the bi-metal to apply a force to vary the bias on a snap acting load current switch. The load current switch has a movable arm member with a contact mounted on one end thereof and with the opposite end of the moveable arm member pivoted on the controller housing such that movement of the contact with respect to a stationary second contact effects making and breaking of the load current. The moveable arm member has integrally formed therewith as one piece a snap acting blade spring which has the free end thereof attached to the operative end portion of the bi-metal member such that movement of the bi-metal member moves the free end of the blade spring to change the trip point or snap over point of the switch. A user rotatable cam is operative to act on a bias spring connected to the bi-metal member which is connected to the blade spring of the load current switch. Rotation of the cam enables the user to deflect the bias spring and cause the blade spring to effect snap actuation of the load current switch and closing of the load current contacts. The heat motor resistor is energized upon closing of the load current contacts and begins heating the bi-metal. Warpage of the heated bi-metal overcomes the bias spring and moves the blade spring to effect de-actuation of the switch and opening of the contacts to thereby break the load current and also shut off the heat motor. Subsequent cooling of the bi-metal effects movement of the switch blade spring and effects snap-action of the switch to reclose the load current contacts and re-energize the heat motor thus resuming the cycle. The user operated cam thus enables selection of the ratio of load current "on" to "off" time by varying the preload or bias on the load current switch snap spring.

The bi-metal member is preassembled to the spring of the movable arm member and one end of the arm member is pivoted on a base member with an electrical terminal; and, the heat motor is positioned on the bi-metal member and the assemblage is clipped together with a permanently deformed clip thereby forming a heat motor and load switch subassembly. The electrical terminal of the base member is easily inserted in a housing for mounting the subassembly therein in a convenient manner. The subassembly of the bi-metal member, the movable contact member with integral blade spring and the base terminal member provides a heat motor actuator and snap-acting switch combination which minimizes the number of parts and permits pre-loading of the blade spring and assembly in a manner which is easy to perform in mass production and which minimizes the accumulation of tolerances with respect to assembly of the snap-acting blade mechanism.

The user rotated cam input to the bias spring and bi-metal member as opposed to portions of the snap-acting switch blade provides increased accuracy of setting of the bias on the switch to improve the ease and accuracy of varying the duty cycle of regulation of the load current.

In another aspect of the invention, the user rotated cam has a shaft extending therefrom outwardly of the controller housing which has an integrally formed deflectable spring portion so as to frictionally engage the user control knob when the knob is axially assembled onto the shaft.

In another aspect of the invention, the preassembly of the bi-metal, heater, movable contact member and base terminal member to form a sub-assembly facilitates installation in the controller housing. The force input from the user rotatable cam to bias spring and to the bi-metal member produces sufficient accuracy in the subassembly and stability of the snap-acting switch such that upon assembly into the housing, the calibration of the snap-acting load current switch with the cam may be accomplished merely by adjusting the position of the stationary contact for the load current switch.

The present invention thus provides a unique and novel controller for duty cycle regulating an electrical load current and employs a heat motor energized upon user rotation of a cam to close a load current switch. Concurrent energizing of the heat motor overcomes the bias on the load current switch; and, upon attainment of the desired percentage of time, de-actuates the load current switch cutting of the load current and the heat motor. Upon cooling of the heat motor, the cycle is repeated thereby modulating or regulating the load current at the desired fractional duty cycle. The invention employs a unique subassembly of the heat motor and snap-acting load current switch which minimizes the number of parts and improves the accuracy of the switch calibration and operation upon installation in the controller housing for making and breaking a circuit with an adjacent stationary contact. The user control knob is axially assembled over a cam shaft extending externally of the controller housing which shaft has an integrally formed spring frictionally engaging the knob for retaining the knob on the shaft.

DETAILED DESCRIPTION OF THE INVENTION

Figure 1A:
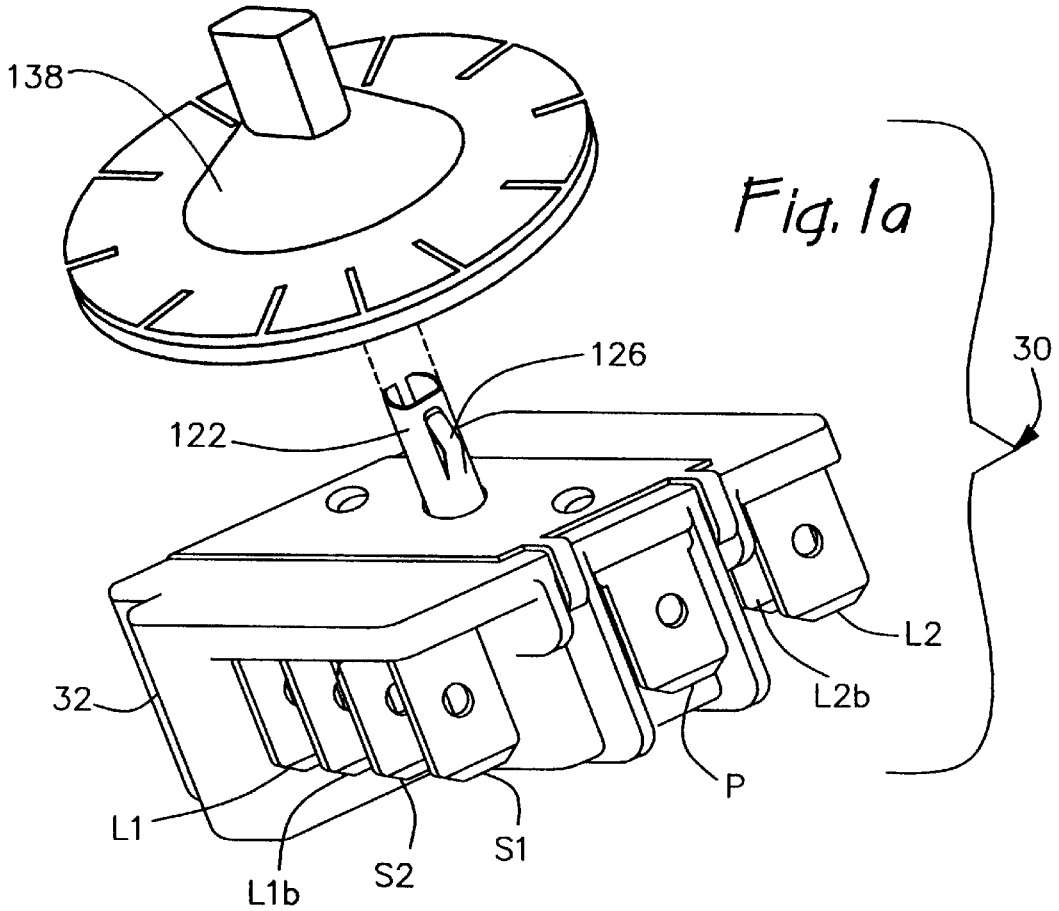
FIG. 1*a* is an axonometric view of the assembled controller of the present invention.

Referring to FIGS. 1*a*, 1*b*, 2, 3, 5 and 22, the controller of the present invention is indicated generally at 30 and has a housing 32 with a user rotated cam indicated generally at 34 journalled for rotation in the housing and which has a first or outer cam track 36 formed thereon. A second intermediate cam track 38 and a third smaller diameter cam track 40 formed thereon in axially spaced arrangement on the cam 34. The controller has a first heater load connecting terminal H1 which is integrally formed with a switch support or base member 42 which serves to support the moveable parts of the load current switch as will hereinafter be described. A second load heater connector terminal H2 is mounted on the housing and has attached thereto a stationary contact 44 which forms one side of a second switch indicated generally at 46.

A first power line connector terminal L1 has attached thereto a secondary line connector terminal L1*b* and also a stationary contact 48 which forms one side of a load current switch indicated generally at 50. A second line power terminal L2 and an auxiliary second line terminal L2*b* are provided with the terminal L2*b* having a stationary contact 52 provided thereon which forms one side of a third switch indicated generally at 54.

An auxiliary set of connector terminals S1, S2 are provided with S1 having connected thereto a blade arm 56 which has attached to the end thereof a moveable contact 58; and, terminal S2 has connected thereto a stationary contact 60 which forms one side of a fourth switch indicated generally at 62 with the moveable contact 58 forming the other side thereof. The blade arm 56 is curved to form a cam follower for following the cam track 38 of cam 34. The switch 62 is an auxiliary function switch may be connected through terminals S1, S2 for any desired auxiliary function.

A pilot connecting terminal P has connected thereto a blade arm 66 which has a moveable contact 68 provided on the free end thereof which forms one side of second switch 46.

Blade arm 66 has a second blade arm 69 attached to or formed integrally with the free end of arm 66. The second blade arm 69 extends in cantilever from arm 66 and toward switch 54; and, second arm 69 has a moveable contact 64 provided on the free end thereof which forms one side of switch 54. The second blade arm 69 has a cam follower 67 formed thereon which follows cam track 40 of cam 34. Upon user rotation of the cam 34, track 40 sequentially closes first switch 46 and then switch 54. Upon the cam follower 67 being raised to the greater diameter surface of track 40 and upon the cam follower 67 dropping into the notch of cam track 40, the switches 54, 46 open in reverse order of closing.

The load current switch 50 comprises a subassembly indicated generally at 70 which includes a moveable arm 72 pivoted on the base member 42 as will hereinafter be described at one end thereof and having a moveable contact 74 formed on the opposite or free end thereof and which forms one side of the load current switch 50. A bias spring 79 has one end anchored and the other end contacting a portion of the subassembly 70 as will hereinafter be described; and, bias spring 79 has formed thereon a cam follower 77 which is operative to follow cam track 36 on the cam 34.

Figure 1B:
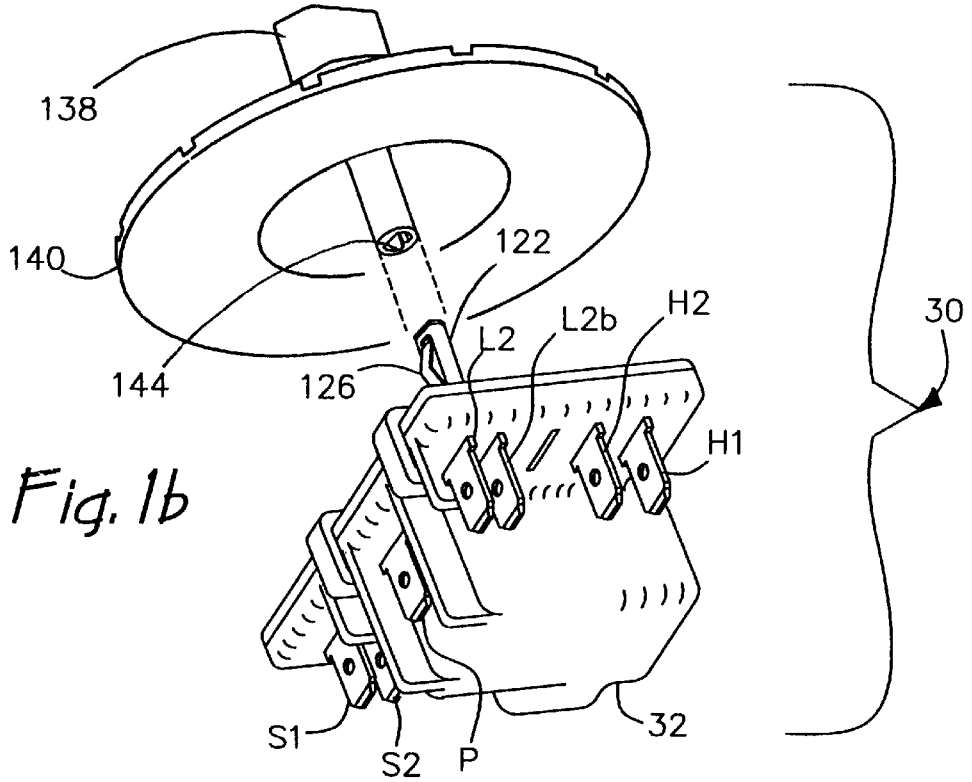
FIG. 1*b* is a view similar to FIG. 1 looking at the controller from backside.

It will be understood that each of the connector terminals L1, L1*b*, S1, S2, H1, H2, L2, L2*b* and P extends through slots such as slot 81 for terminal L2 in housing 32 and extend outwardly from the rear face of housing 32 as shown in FIGS. 1*a* and 1*b*.

Figure 4A:
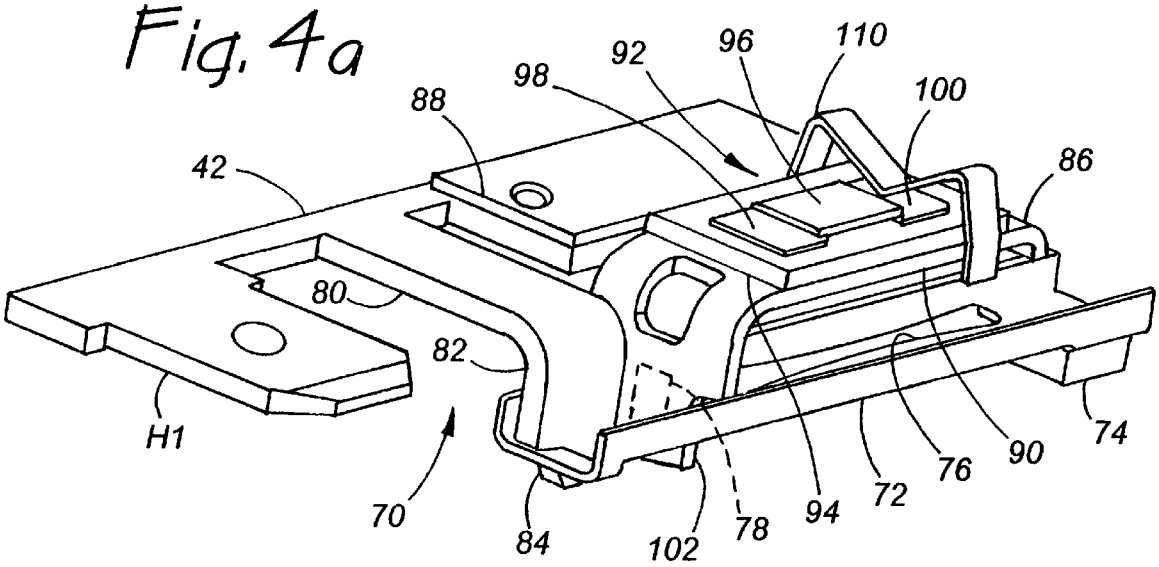
FIG. 4*a* is an axonometric view of the subassembly of the heat motor, movable switch member and base terminal member.
Figure 4B:
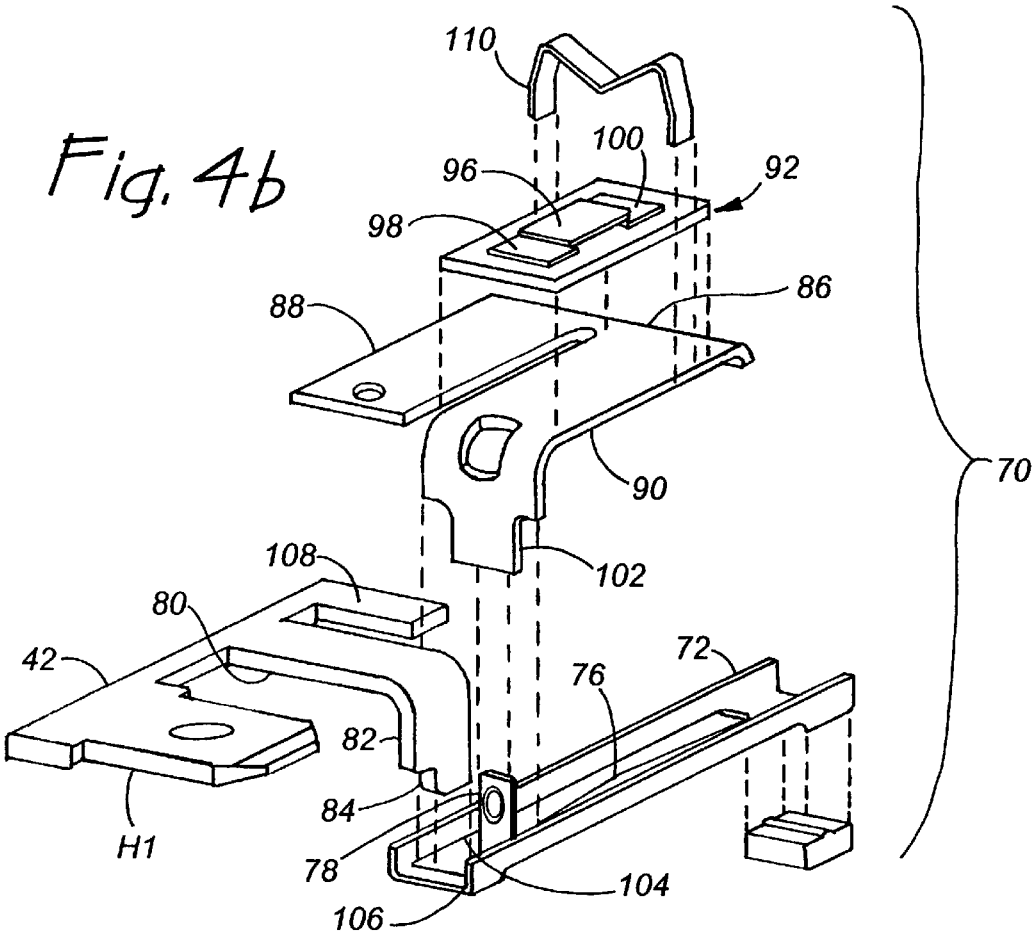
FIG. 4*b* is an exploded view of the subassembly of FIG. 4*a*.
Figure 5:
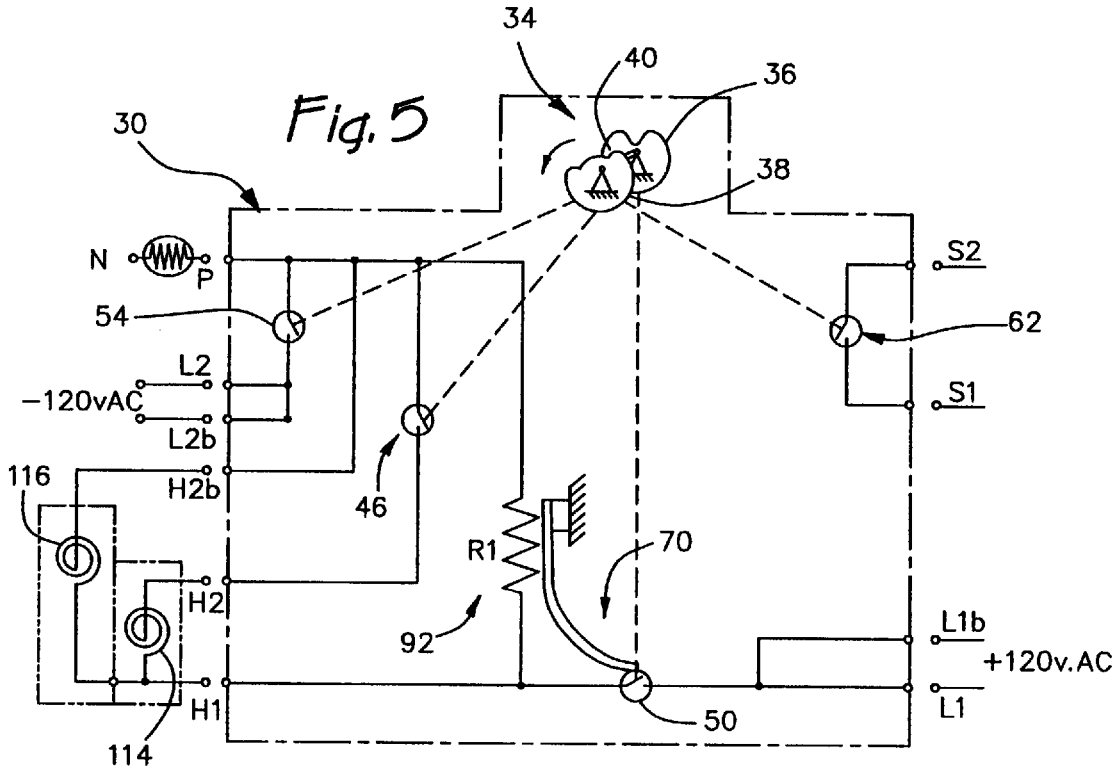
FIG. 5 is an electrical schematic of an embodiment of the invention with a pilot light and auxiliary load switch.

Referring to FIGS. 4*a* and 4*b*, the subassembly 70 includes the moveable arm member 72 with moveable contact 74 attached to one end thereof and which is operable for making and breaking the load current against stationary contact 48. The moveable arm 72 has integrally formed therewith as one piece an elongated blade spring 76 and which extends in cantilever from the end adjacent contact 74 and has the free end 78 thereof formed at right angles to the direction of elongation.

The base or support member 42 has an arm 80 formed thereon which extends preferably in spaced parallel relationship to the connector terminal H1, which arm 80 has the end 82 thereof formed at right angles thereto and provided with a registration surface in the form of a notch or shoulder 84 which functions as will be described hereinafter.

A bi-metal member indicated at 86 is formed of flat plate or sheet stock and has in plan form a generally U-shaped or bifurcated configuration with one leg 88 thereof forming a temperature compensating portion; and, the opposite leg 90 forms an active leg and part of a heat motor indicated generally at 92. Heat motor 92 includes bi-metal arm 90, an insulating, preferably ceramic, substrate 94 with a relatively thin resistive strip 96 mounted on the surface of the substrate 94. The resistive strip 96 has end conductive pads 98, 100 provided in association therewith on the surface of the substrate 94.

The active bi-metal arm 90 has the free end thereof formed downwardly at right angles thereto as denoted by reference numeral 102 and is sized to interfit the cutout 104 in the contact arm 72 from which the blade spring 76 is stamped.

The subassembly 70 is assembled by first attaching the contact 74 to the end of arm 72 which is preferably accomplished by suitable weldment such as brazing or resistance welding or any other suitable expedient. The next step is the attachment of bi-metal end tab 102 to the end 78 of the switch blade spring which in the presently preferred practice is accomplished by weldment.

With suitable fixtures (not shown) clamping bi-metal arm 88 to leg 108 of the base, the arm 88 of the bi-metal is secured to leg 108 by a suitable expedient such as weldment and the unshown fixtures removed.

The end 106 of cutout 104 of moveable contact arm 72 is then assembled onto the notch 84 formed in end portion 82 of arm 80 of base 42; and, the leg 88 of the bi-metal is fixture upon a third arm portion 108 of base 42 such that tension is introduced to the member 72. Alternatively legs 80 and 10 of base 42 may be formed as one extension thereof. The blade spring 76 is thus placed in longitudinal compression with the end 106 of the arm pivoting in notch 84. Blade spring thus provides a snap action to the pivotal movement of arm 72.

The next step in the fabrication of subassembly 70 is the attachment of the resistor 96 and conductive tabs 98, 100 to the substrate 94; and, the preassembly thereof is then attached to the surface of leg 90 of the bi-metal by a clip 110 in a manner as will be described. Alternatively, heat motor 92 may be assembled prior to attachment of end 106 of contact arm 72 to notch 84 of the end 82 of leg 80 of base 42.

Figure 12:
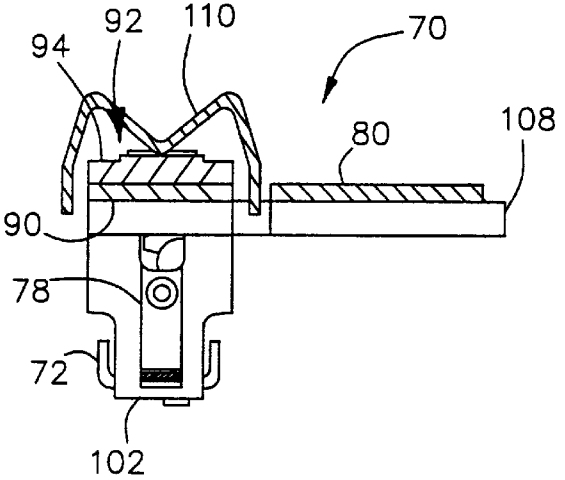
FIG. 12 is a section view taken along section indicating lines 12—12 in FIG. 11.
Figure 11:
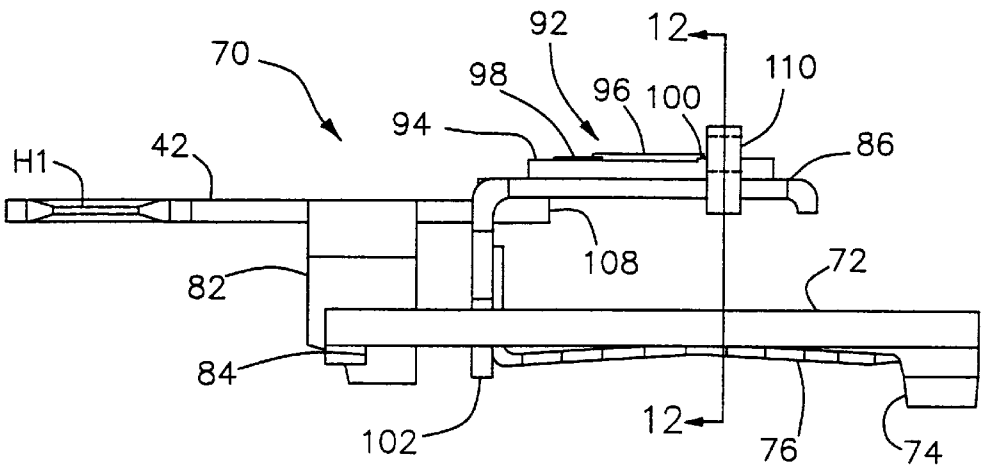
FIG. 11 is a side view of the subassembly of FIG. 3 upon initiation of assembly.

Referring to FIGS. 11 through 16, the assembly of the heat motor 92 is illustrated wherein the initial step is shown in FIGS. 11, 12 and includes positioning the preassembly of the substrate and resistor onto the arm 90 and positioning the clip 110 thereover.

Figure 14:
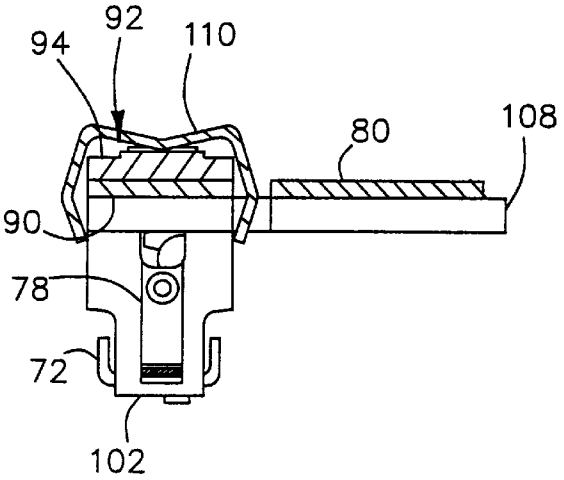
FIG. 14 is a section view taken along section indicating lines 14—14 in FIG. 13.
Figure 13:
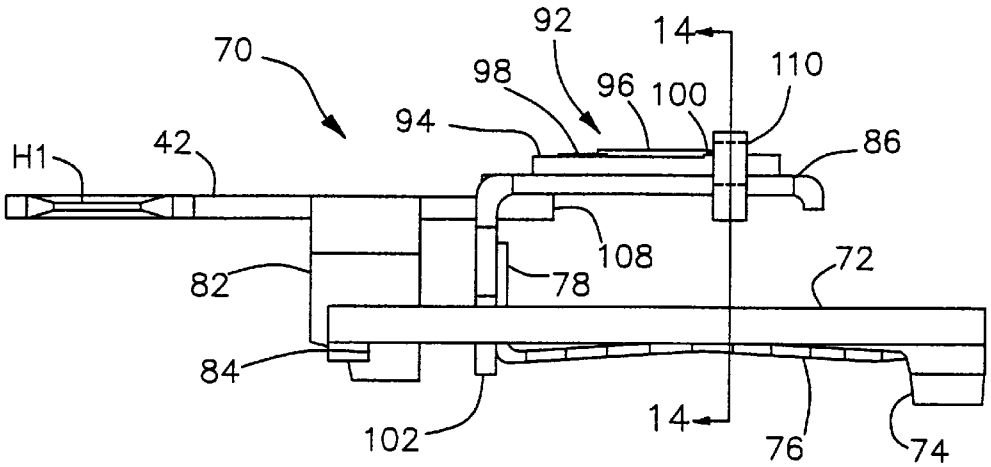
FIG. 13 is a view similar to FIG. 11 of the second stage of assembly.

Referring to FIGS. 13, 14, the next step in the sequence is the downward movement of the sides of clip 110 to the position shown in FIGS. 13 and 14. It will be understood that this movement of the clip 110 is accomplished by supporting the members and suitable fixtures (not shown) and by the use of suitable forming tools (not shown), the details of which have been omitted for the sake of brevity.

Figure 16:
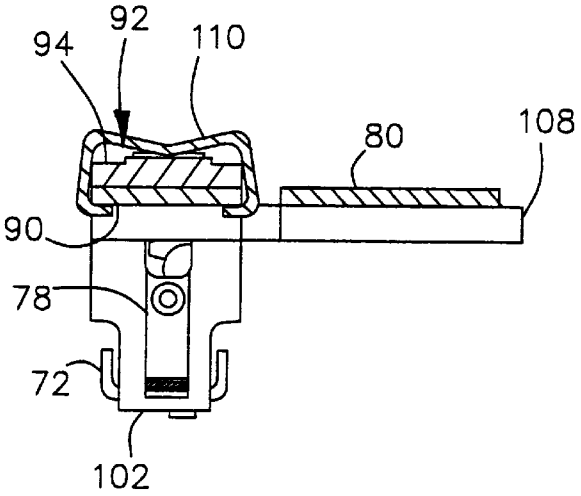
FIG. 16 is a section view taken along section indicating lines 16—16 in FIG. 15.
Figure 15:
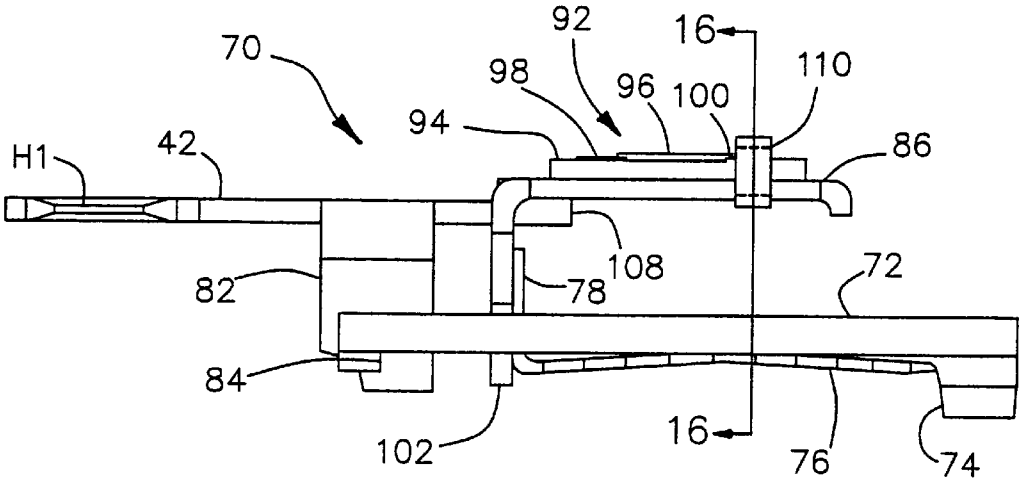
FIG. 15 is a view similar to FIG. 13 of the final stage of assembly.

Referring to FIGS. 15, 16 the final step of the assembly of the heat motor 92 is shown wherein the ends of the clip 110 have been folded under the arm 90 of the bi-metal to secure the substrate, with the resistor and pads 98, 100 thereon, to the arm 90.

Figure 2:
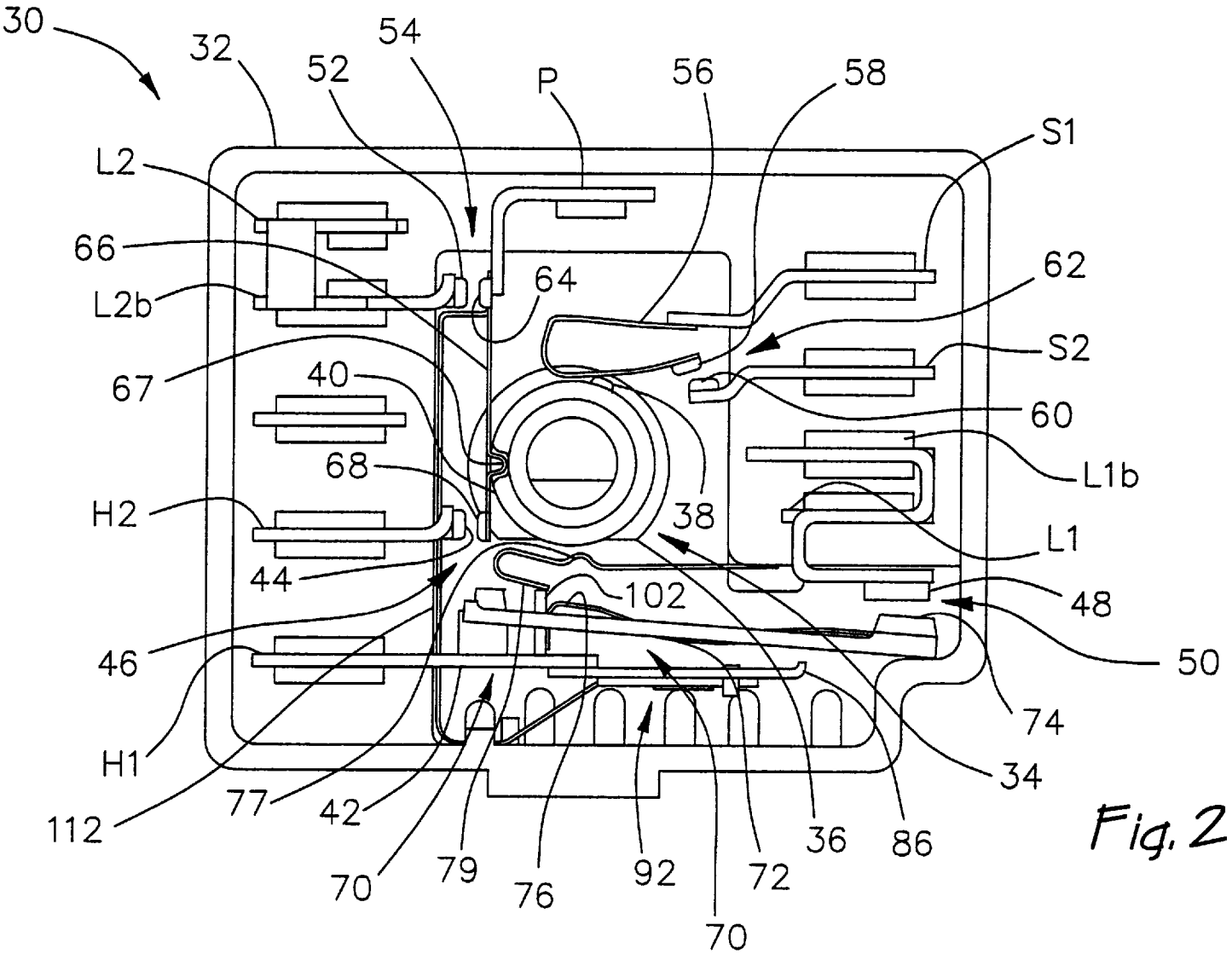
FIG. 2 is a view of the controller of FIG. 1 with the cover removed with the user cam in the "off" position and the load current switch open.
Figure 3:
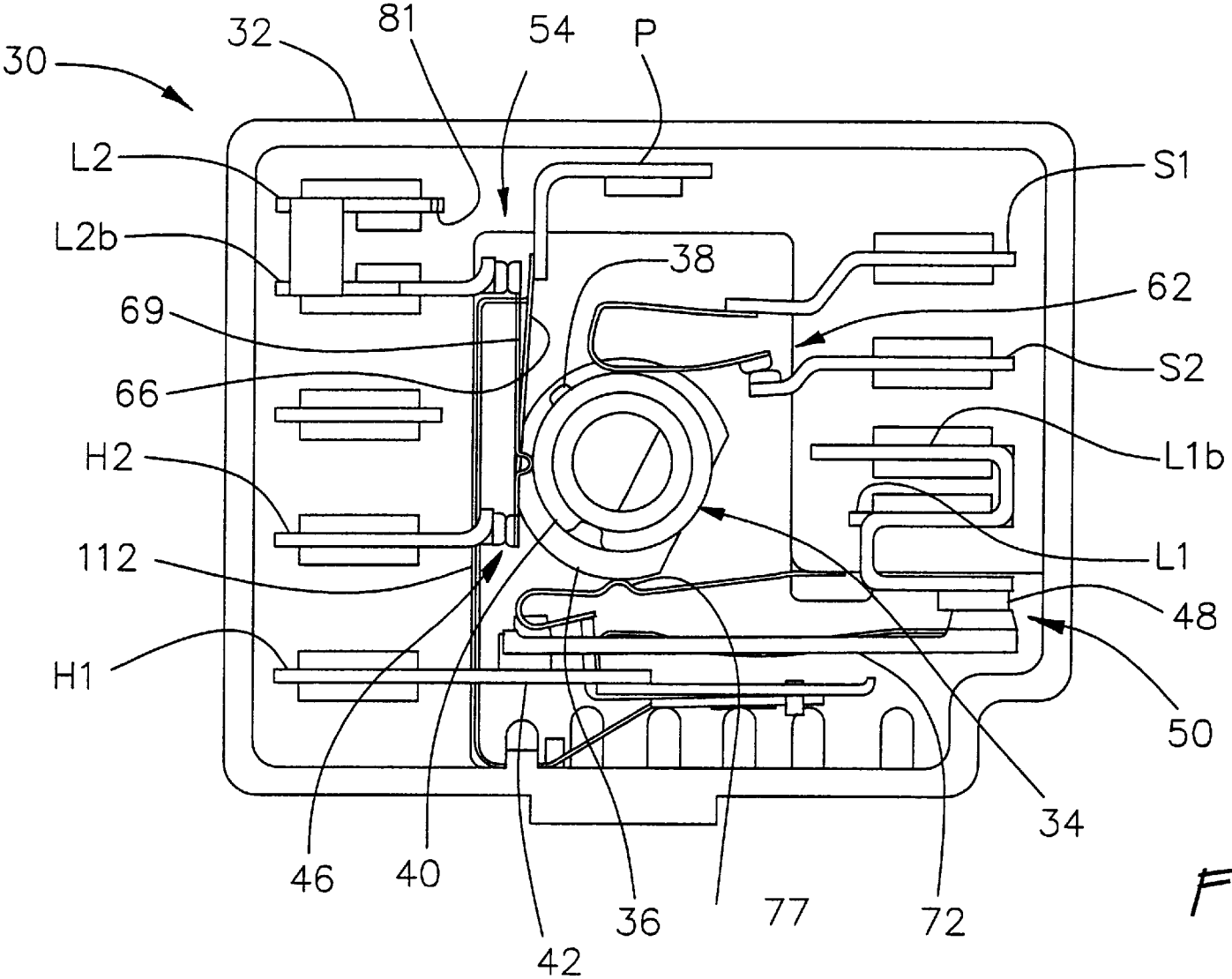
FIG. 3 is a view similar to FIG. 2 with the load current switch closed by rotation of the user cam.

Referring to FIGS. 2 and 3, a conductive strip 112 is attached to terminal P and extends to make surface contact with one of the pads 98 on the heat motor 92 to provide electrical current flow thereto. The conductive pad 100 on opposite end of the resistor 96 is electrically connected by surface contact with central portion of clip 110 to the bi-metal arm 90 and through the blade spring 72 to contact 74 which, upon closing against stationary contact 48 of line connector L1 provides power to the heat motor 92. Thus, upon closure of the third switch 54, power is supplied from line connector L2 through switch 54, strip 112, through pad 98, resistor 96, pad 100, clip 110 and moveable arm 72 and contact 74 to contact 48 and the opposite side of the power line through terminal L1.

In the present practice of the invention, a first load heater 114 is connected across connector terminals H1, H2; and, a second load heater 116 is connected across connector terminals H1, H2*b*. The heaters 116, 114 may be either oven heating elements or surface heating elements as typically found on the top of a domestic cooking range.

In operation, user rotation of the cam 34 first closes switch 46 as shown in FIG. 3 by deflection of the connector member 66 and then farther rotation deflects blade arm 69 attached to the end of member 66 and sequentially closes switch 54. The closing of switch 46 connects load heater 114 to the neutral, which is typically ground in a three wire 240 Volt system, thus arming the heater 114 subject to the state of switch 50. Closure of switch 54 connects the heaters 114, 116 to the opposite side of the 240 V power line thereby applying full voltage to the heaters 114, 116 subject to the state of switch 50. User rotation of the cam 34 to the desired position as would typically be indicated on a dial or by indicia on the user control knob to the desired indicated temperature setting, causes cam track 36 to apply the pre-calibrated amount of deflection to bias spring 77. This deflection of cam follower 77 causes the end 79 thereof to move the end 102 of the bi-metal and the blade spring 76 downwardly through the center of member 72 and effect a snap action of the member 72 about the notch 84 which causes contact 74 to close against contact 48 thereby closing switch 50. Closure of switch 50, as previously described, energizes heat motor 92 which warps the bi-metal arm 90 after a predetermined amount of heat transfer to the bi-metal arm 90, which warpage overcomes the bias of the spring 79 and moves the blade spring 76 upwardly causing a reverse snap action and reopening of the contacts 50. This breaks the flow of current to the heat motor 92 and also the load current through connector H1. When the bi-metal has cooled sufficiently, the bias of spring 79 is again operative to reclose contacts of switch 50. The user positioning of cam track 36 to vary the bias of spring 79 against the spring 76 thus determines the ratio of the time the switch 50 is open as compared to the time the switch is closed thus varying the duty cycle of the flow of load current through terminal H1. In calibrating the controller of the present invention, the snap point of switch 50 is adjusted by bending the portion of L1 supporting stationary contact 48.

Arm 88 of bi-metal member 86 provides ambient temperature compensation of the position of the end 102 of arm 90.

Figure 6:
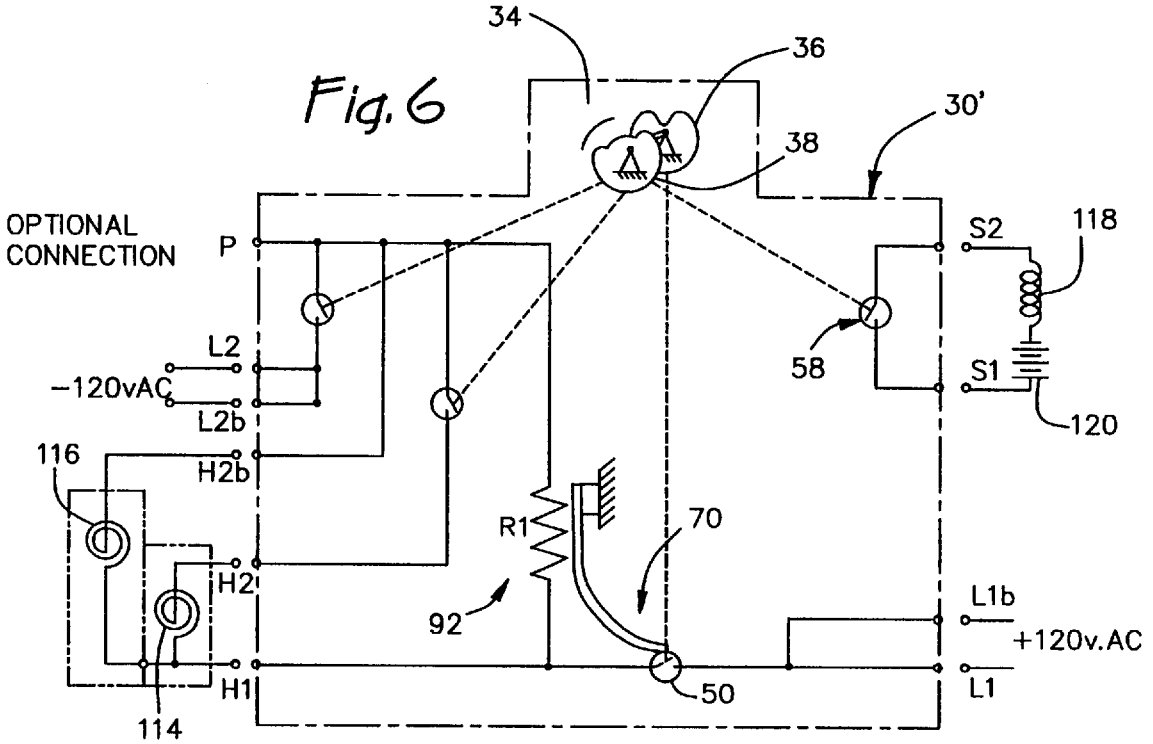
FIG. 6 is a schematic similar to FIG. 5 of an alternate arrangement.
Figure 7:
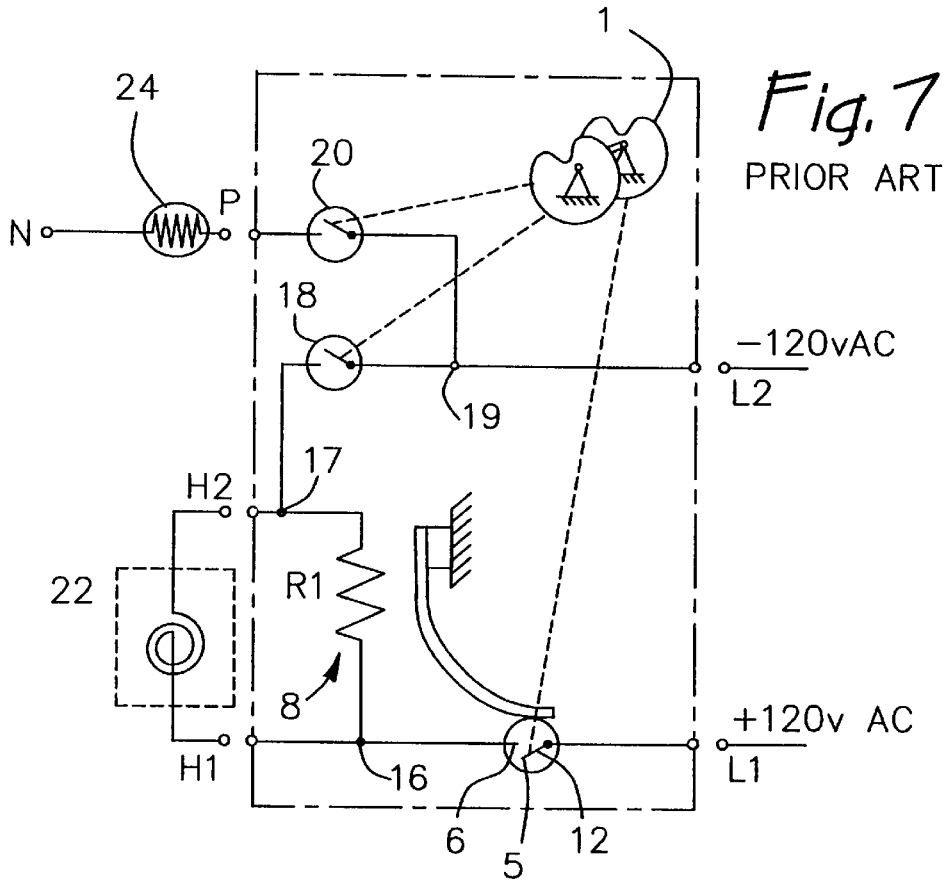
Fig. 7 PRIOR ART
FIG. 7 is a schematic of a prior art device.
Figure 8:
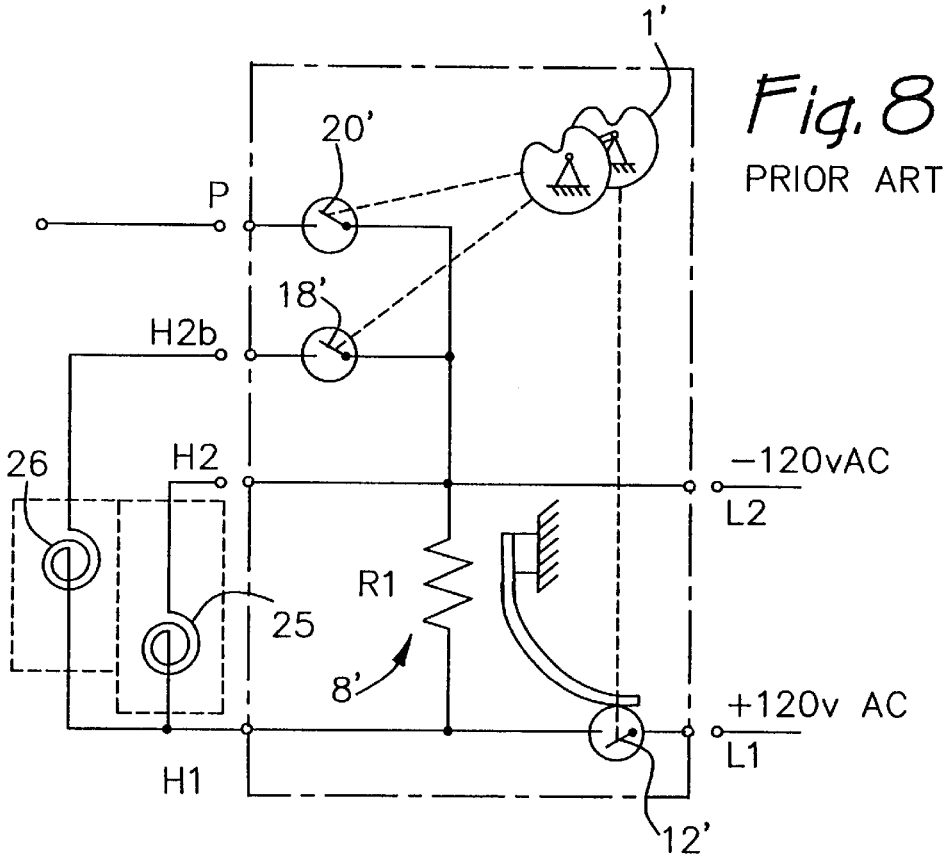
Fig. 8 PRIOR ART
FIG. 8 is a schematic of another prior art device.
Figure 9:
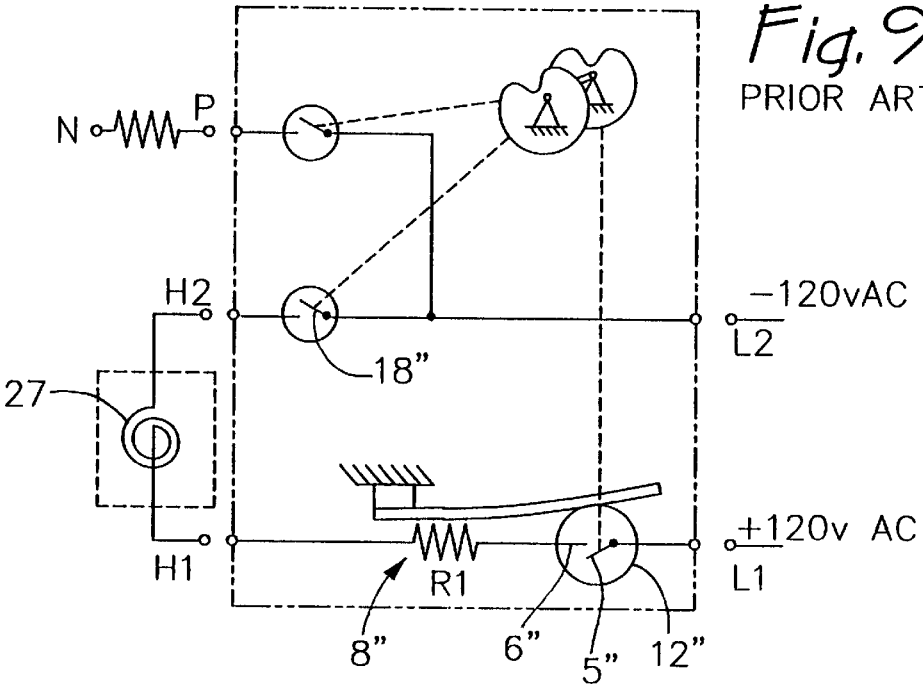
Fig. 9 PRIOR ART
FIG. 9 is a schematic of another prior art device.
Figure 10:
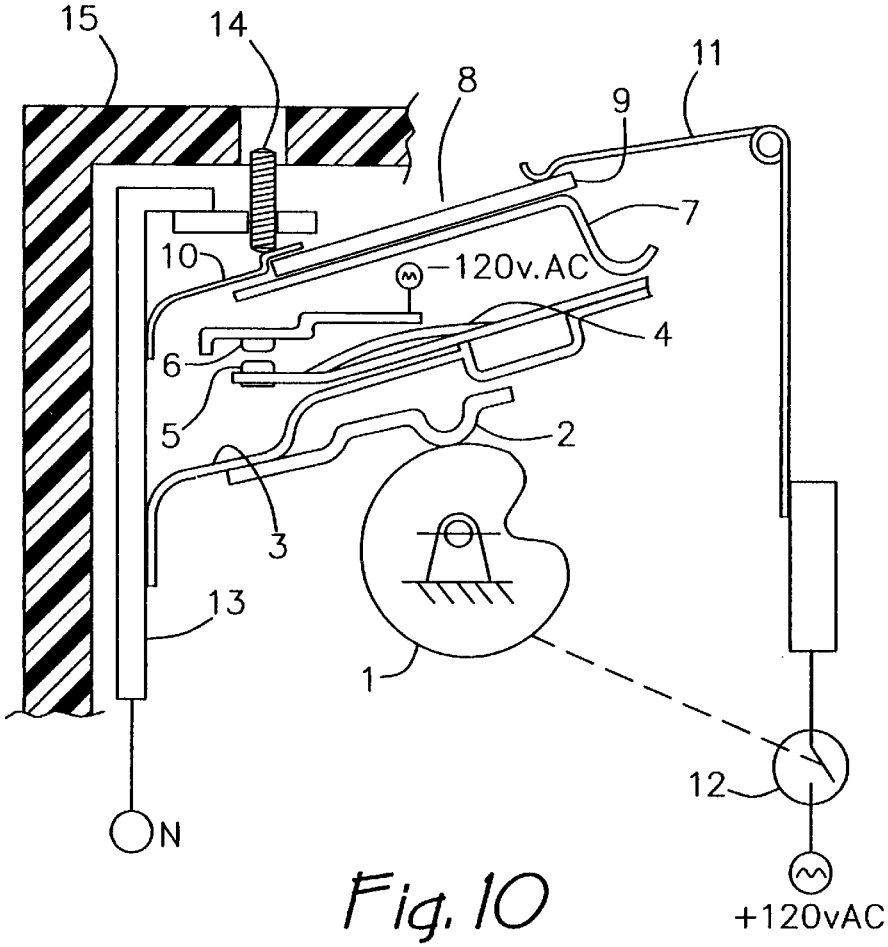
Fig. 10 PRIOR ART
FIG. 10 is a view similar to FIG. 2 of the prior art device of FIG. 7.

Referring to FIG. 6, an alternative embodiment of the invention is shown wherein an auxiliary load 118 is connected to a power supply 120 and is controlled by switch 58. In the embodiment of FIG. 6, the pilot light has been eliminated and the terminal P is available for other uses. It will be understood that the operation of the system of FIG. 6 is otherwise identical to that of FIG. 5.

Figure 17:
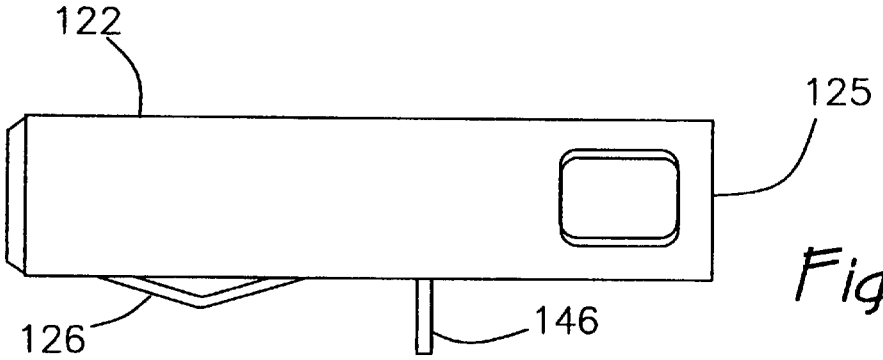
FIG. 17 is a side view of the end portion of a user input knob shaft of the present invention.
Figure 18:
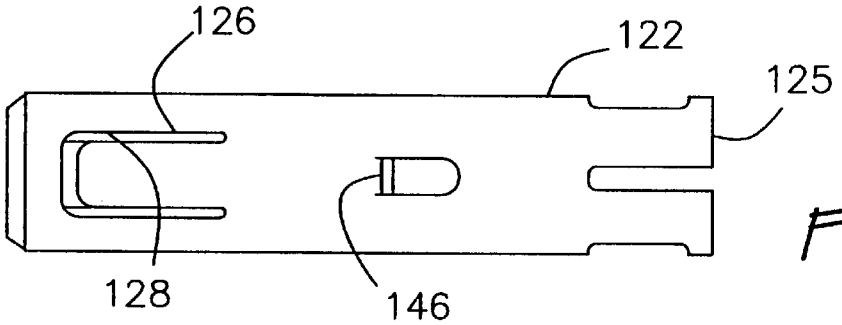
FIG. 18 is a bottom view of the shaft of FIG. 17.
Figure 19:
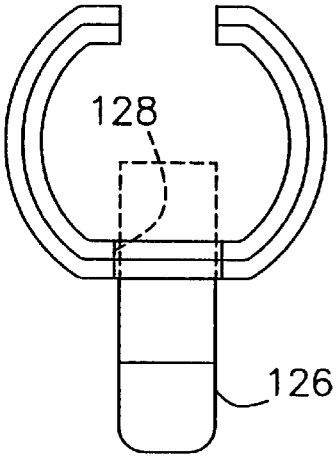
FIG. 19 is an enlarged end view of the shaft of FIG. 17.
Figure 23:
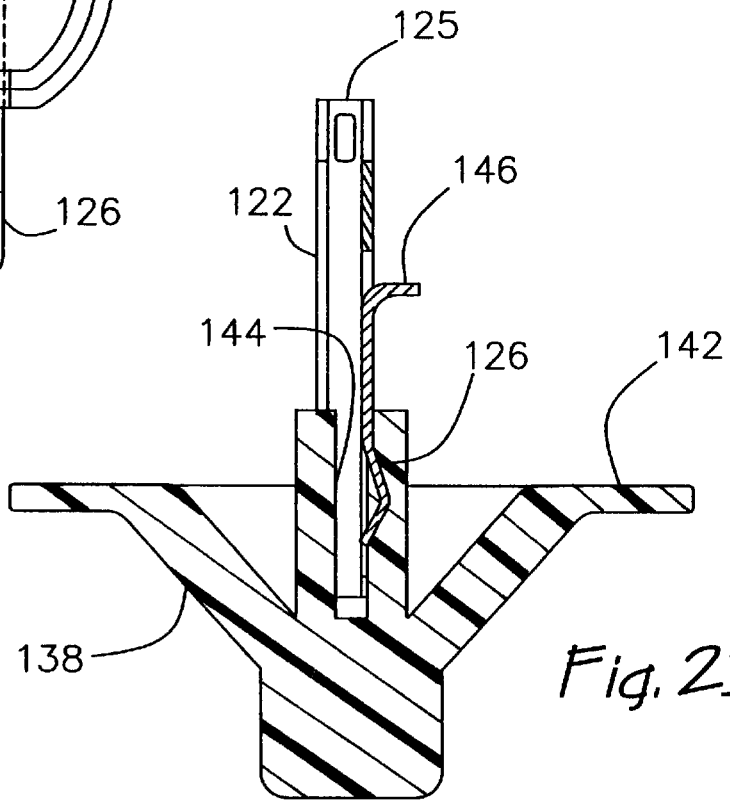
FIG. 23 is a cross-section of shaft and knob of the embodiment of FIGS. 1*a* and 1*b*.

Referring to FIGS. 1*a*, 1*b*, 17, 18, 19, 22 and 23 another aspect of the invention is illustrated wherein shaft 122 which is configured to have one end 125 received in the bore 124 of cam 34 and drivingly engaged therein in any suitable manner. Shaft 122 has thereon, distal end 125, an integrally formed spring member 126 provided thereon which is radially deflectable to the position shown in dashed outline in FIG. 19 through the slot 128 formed in the shaft upon assembly of user control knob 138 thereover. Knob 138 has an enlarged diameter flange 140 which may have position indicia 142 thereon to facilitate user selection of a desired temperature, which is pre-calibrated with the rotary position of the knob 138. Knob 138 also has a bore 144 formed on the underside thereof as shown in FIG. 1*b*. Bore 144 is configured to drivingly engage the end of shaft 122. The knob 138 is frictionally retained on the shaft 122 by the deflection of spring 126. In the embodiment of FIGS. 17 through 19, the shaft is formed of sheet stock which is roll formed in a generally C-shaped configuration in transverse section as shown in FIG. 19. If desired, a limit stop 146 may be formed on shaft 122 to limit axial insertion into cam bore 124. Stop 146 may also facilitate a requirement for axial displacement of the shaft prior to engagement, e.g., pull-to-turn.

Figure 20:
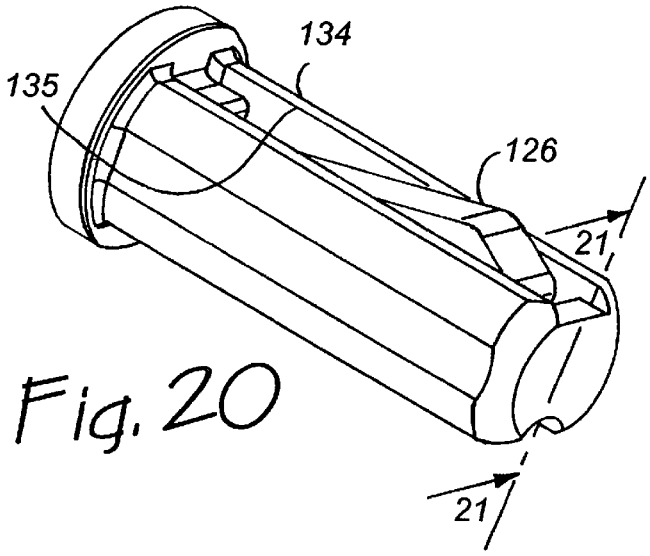
FIG. 20 is an axonometric view of an alternative embodiment of the user input shaft.
Figure 21:
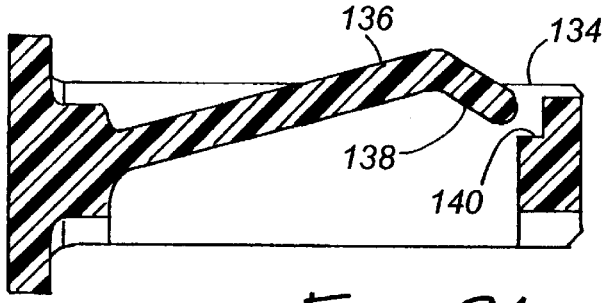
FIG. 21 is an enlarged section view taken along section indicating lines 21—21 of FIG. 20.
Figure 22:
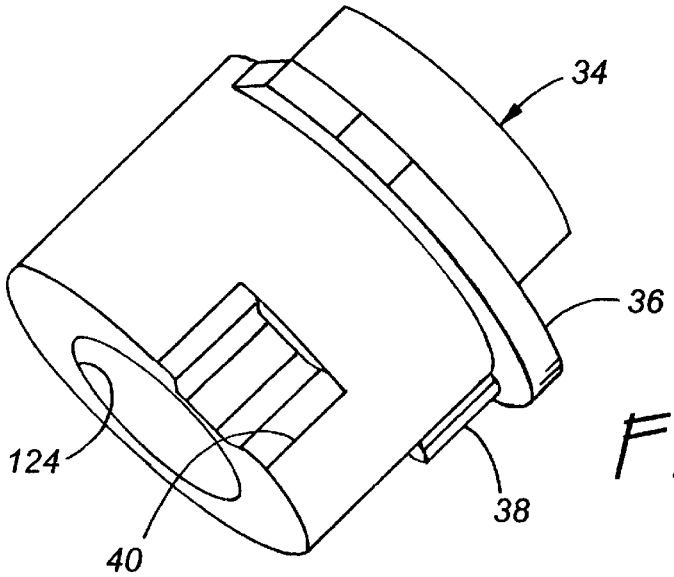
FIG. 22 is an axonometric view of the user rotatable cam.

Referring to FIGS. 20 and 21, another embodiment of the shaft 134 is formed integrally as one piece of plastic material and has a longitudinally or axially extending slot 135 which extends transversely through the shaft and has formed therein a cantilevered spring member 136 which in its free position has a portion thereof extending radially outwardly of the surface of the shaft. Upon assembly of the shaft 134 into knob bore 144, spring 136 is deflected radially downwardly until the free end 138 thereof registers against a notch 140 provided in the transverse end of the slot to thereby stiffen the spring and frictionally retain the cam thereon.

The present invention thus provides a unique and novel controller for duty cycle regulating an electrical load with a user selectable fractional duty cycle of "on" time. The controller of the present invention employs a heat motor utilizing a bi-metal which, upon heat transfer thereto and warpage thereof, overcomes the bias of a spring pre-deflected by the user rotation of a cam which bias is applied to the load current switch. The controller of the present invention has a minimum of parts and has the heat motor configured to simplify manufacture, assembly and calibration.

The controller of the present invention utilizes a subassembly comprising the heat motor and moveable portions of the load current switch with a load connector terminal as a base, which subassembly simplifies the final assembly of the controller and improves the accuracy and repeatability of the controller operation.

Although the invention has hereinabove been described with respect to the illustrated embodiments, it will be understood that the invention is capable of modification and variation and is limited only by of the following claims.

I claim:

1. A controller for duty cycling or regulating first and second electrical loads comprising:

(a) a housing structure;

(b) a switching structure associated with said housing structure and including a moveable switch member, operable upon movement to effect snap-action making and breaking of a first set of electrical contacts;

(c) a cam means operable upon user movement thereof to effect said movement of said switch member for said first set;

(d) a heat motor operative upon connection to a source of power to effect cycling of said movement of said switch member for said first set when said cam means has effected said member movement for making said first set of contacts, wherein said first set of electrical contacts is connected with said heat motor means and a first electric load and wherein a second set of contacts is also connected with said first electrical load and said power source;

(e) a third set of contacts series connected with a second electrical load and said second set of contacts; and, (f) said second and third sets of contacts are operated by said cam means.

2. The assembly defined in claim 1, wherein said switching structure includes an operator member having U-shaped configuration with an end of one leg of said U-shape anchored to said housing structure with said operator member extending in cantilever therefrom with a second leg of said U-shape operatively connected to said moveable switch member.

3. The assembly defined in claim 1, wherein said moveable member includes an integrally formed blade spring loaded in longitudinal compression for effecting said snap-action.

4. The assembly defined in claim 1, wherein said moveable member includes an integrally formed blade spring operative upon said movement to undergo over-center movement for effecting said snap-action; and, said heat motor is operative upon energization to cause said over-center movement for effecting breaking of said first set of contacts.

5. The controller defined in claim 1, further comprising a fourth set of contacts series connected between an auxiliary load and a power supply, said fourth set of contacts being actuated by said cam means.

6. The controller defined in claim 1, wherein said first set of contacts includes a snap-acting blade spring member; and, said cam means is operative to contact said second end of said U-shaped operator member for effecting cam actuation of said first set of contacts.

7. A heat motor operated regulating switch assembly comprising:

(a) a base member having a projection extending therefrom;

(b) a bi-metal member having a U-shaped configuration and having an end of a first leg of said U-shape attached to said base member and extending in cantilever therefrom;

(c) a heater attached to said bi-metal member and operable upon electrical energization to effect warping of said bi-metal;

(d) a moveable contact member having a blade spring integrally formed therewith and extending from a first end thereof toward a second end distal said first end, said contact member having said second end registered on said base projection and having said blade spring having first portions connected to a second end of said bi-metal distal said bi-metal first end, said bi-metal having second portions connected intermediate the ends of said contact member, wherein said blade spring is placed in compression;

and, upon over-center movement thereof said blade spring effects a snap-action movement of said contact member wherein said first end of said contact member includes structure which functions as a moveable electrical contact; and, (e) a stationary contact disposed adjacent said moveable contact structure wherein, upon energization of said heater, said bi-metal moves said blade spring over-center and effects snap-actuation of said contact member in one direction, and upon de-energization of said heater, said bi-metal cools and effects snap-actuation of said contact member in a direction opposite said one direction.

8. The switch assembly defined in claim 7, wherein said heater comprises resistive material disposed on the surface of said bi-metal member with said resistive material electrically connected to said blade spring.

9. The switch assembly defined in claim 7, wherein said bi-metal has a flat plate configuration with a flange portion thereof at right angles thereto with said flange portion attached to said blade spring.

10. The switch assembly defined in claim 7, wherein said contact blade member has an elongated channel shaped configuration with said spring formed integrally int eh web of said channel configuration.

11. The switch assembly defined in claim 7, wherein said blade spring is attached to said bi-metal member by weldment.

12. The switch assembly defined in claim 7, wherein said bi-metal member is attached to said base by weldment.

13. The switch assembly defined in claim 7, wherein said moveable contact structure has a noble metal contact attached thereto.

14. The switch assembly defined in claim 7, wherein said moveable contact is electrically series connected with said heater.

15. The switch assembly defined in claim 7, wherein said spring has an end thereof contacting said heater for electrically connecting said moveable contact member therewith.

16. The switch assembly defined in claim 7, wherein said blade spring has a L-shaped configuration with an end portion of said L-shape connected to said bi-metal member.

17. The switch assembly defined in claim 7, further comprising an ambient temperature compensator attached to said bi-metal member.

18. The switch assembly defined in claim 7, wherein said bi-metal member includes an active portion heated by said heater and an ambient temperature compensation portion not heated by said heater.

19. The switch assembly defined in claim 7, wherein said bi-metal member has one leg of said U-shape forming an active leg with said heater attached thereto and with the other leg of said U-shape being unheated and comprising an ambient temperature compensating element.

20. An electrical load cycling switch assembly comprising:

(a) a housing structure having first and second line power connecting terminals and first, second and third load connecting terminals thereon;

(b) a user operated cam mounted for rotation on said housing structure;

(c) a first switch assembly including a spring member and a moveable contact member mounted on said housing, with a portion thereof comprising said first load connecting terminal (H1), said first switch operative for making and breaking a circuit with said first line power connecting terminal (L1);

(d) a cam follower operable upon user rotation of said cam for effecting a variable bias on said first switch assembly spring member;

(e) a second switch associated with said housing and having one side connected to said second load connection terminal (L2) and a moveable member operative to contact said cam for user actuation thereof in response to user rotation of said cam, wherein said second switch a second side connected to one side of a third switch, said third switch having the other side thereof connected to said second load connecting terminal (H2), wherein said variable bias is operative actuate said switch to the closed condition; and, said first switch includes a bi-metal actuator including a heat motor energized upon closing of said first switch for effecting warping of said bi-metal member and opening of said first switch causing said heat motor to be de-energized; whereupon said bi-metal member cools effecting redosing of said first switch.

21. The switch assembly defined in claim 20 said second and third switches have one side thereof formed on a common member.

* * * * *